United States Patent [19]

Eckold et al.

[11] Patent Number: 4,584,753

[45] Date of Patent: Apr. 29, 1986

[54] APPARATUS FOR CONNECTING SHEET METAL PIECES

[76] Inventors: Gerd-Jürgen Eckold, Silberhutte 11, FRG-3424, St. Andreasberg; Hans Maass, Germelmannstr. 12, FRG-3422, Bad Lauterberg, both of Fed. Rep. of Germany

[21] Appl. No.: 713,678

[22] Filed: Mar. 19, 1985

[30] Foreign Application Priority Data

Mar. 22, 1984 [DE] Fed. Rep. of Germany ... 8408795[U]

[51] Int. Cl.[4] ..... B23P 11/00

[52] U.S. Cl. ..... 29/243.5; 29/432.1; 29/509; 72/465

[58] Field of Search ..... 29/243.5, 509, 432.1; 72/395, 396, 465

[56] References Cited

U.S. PATENT DOCUMENTS

| | | | |
|---|---|---|---|
| 2,288,308 | 6/1942 | Williams . | |
| 2,671,361 | 3/1954 | Sandberg . | |
| 2,688,890 | 9/1954 | Williams . | |
| 2,924,312 | 2/1960 | Williams . | |
| 3,276,112 | 10/1966 | Tantlinger et al. | 29/509 |
| 3,579,809 | 5/1971 | Wolf . | |
| 3,726,000 | 4/1973 | Hafner . | |
| 3,729,804 | 3/1973 | Middleton . | |
| 3,828,421 | 8/1974 | Erlichman . | |
| 3,919,955 | 11/1975 | DuVernay . | |
| 3,934,327 | 1/1976 | Hafner | 29/509 |
| 4,130,922 | 12/1978 | Koett . | |
| 4,173,815 | 11/1979 | Lux et al. | 29/243.9 |
| 4,174,559 | 11/1979 | Persik et al. | 29/509 |
| 4,208,776 | 6/1960 | Schleicher | 29/243.5 |
| 4,459,735 | 7/1984 | Sawdon | 29/509 |

*Primary Examiner*—James L. Jones, Jr.

*Attorney, Agent, or Firm*—Cushman, Darby & Cushman

[57] ABSTRACT

Apparatus for joining a first, non-perforated sheet metal piece to a second, perforated one comprising a male die and a female die, the latter having an anvil which prior to actual joining locates the perforation beneath the male die and is, upon actuation of the apparatus, displaced into a lowered position in which material of the first sheet forced through the perforation by the male die is laterally swaged but is not cut.

6 Claims, 5 Drawing Figures

APPARATUS FOR CONNECTING SHEET METAL PIECES

FIELD OF THE INVENTION

The present invention relates to the technique of forming joints between pieces of sheet metal material and in particular to an apparatus for connecting a first piece to a second one, the latter being provided with one or more perforations.

BACKGROUND OF THE PRESENT INVENTION

Methods and apparatus for joining sheet metal pieces which do not have perforations are disclosed in our pending U.S. patent application, Ser. No. 438,095 filed on Nov. 1, 1982.

The apparatus disclosed in this application comprises a male die and a female die, and the latter as a stationary anvil with adjacent resilient support members provided with cutting edges. In use, the male die penetrates through the pieces to be joined and between the support members thereby cutting through both sheets. The material between the anvil and male die is then compressed and thereby swaged outward so that it flows behind or beyond the edges of the incisions previously formed in the sheet adjacent the female die. In order to permit such lateral swaging, the support members are adapted to flex outwards from the anvil.

SUMMARY OF THE PRESENT INVENTION

It is the object of the present invention to modify the foregoing apparatus such that a non-perforated first piece of sheet metal may be joined or connected to a second sheet metal piece having a perforation at the location of the joint.

According to the present invention, the apparatus comprises a male die and a female die. The female die includes adjacent support members and an anvil therebetween, the anvil having a head portion shaped so as to be complimentary to the contour of the perforation existing in the lower sheet through which the joint is to be made. In most practical applications, the perforation will simply be a circular hole, and the anvil will then have a cylinderically-shaped head portion dimensioned to slidingly-fit into the hole.

The female die further includes a base member in which the anvil is displaceably guided between a first, preparatory position in which it is biased by spring means so as to protrude upwardly beyond the free ends of the support members, and a second swage position in which the anvil rests on a stop member positioned within the base. In this second position, the working surface of the anvil is retracted downwardly below the level of the free ends of the support members. The support members are resilient members, or resiliently mounted or both, and thereby adapted to flex outwardly upon the lateral expansion of material between the male die and the anvil during swaging.

The male die also has a working surface opposite that of the female die anvil, but the surface area of the male die is smaller than that of the anvil working surface so that its outer contour is spaced inwardly from the contour of the perforation. Upon actuation of a press, by means of which male and female dies are moved to and from each other, the male die and the female die cooperate such that:

at first, the female die anvil is located in the perforation of the second sheet, with the two die still being open and spaced from each other, the, the first sheet is properly placed on the second one, and the press is actuated, the male die forces a portion of the material of the first sheet into the perforation of the second sheet thereby displacing the anvil against the spring bias while the support members provide the reaction force, and when the forced-through material protrudes beyond the opposite face of the second sheet, the anvil displacement is stopped and swaging takes place with the support members yielding outwards.

Since the male die contour is spaced inwardly from the inner edge of the perforation, no incisions will occur in the first sheet with the result that the joint remains fluid-tight and the joint is esthetically pleasing.

Other objects, features, and characteristics of the present invention as well as the methods and operation and functions of the related elements of the structure, and to the combination of parts and economies of manufacture, will become more apparent upon consideration of the following description of the preferred exemplary embodiment and the appended claims with reference to the accompanying drawings, all of which form a part of this specification, wherein like reference numerals designate corresponding parts in the various figures. The drawings are simplified in order to show just those features which are important for the implementation of the invention and elements of conventional design and, in particular the press, are not shown.

DETAILED DESCRIPTION OF THE PREFERRED EMBODIMENT OF THE PRESENT INVENTION

Figure 1:
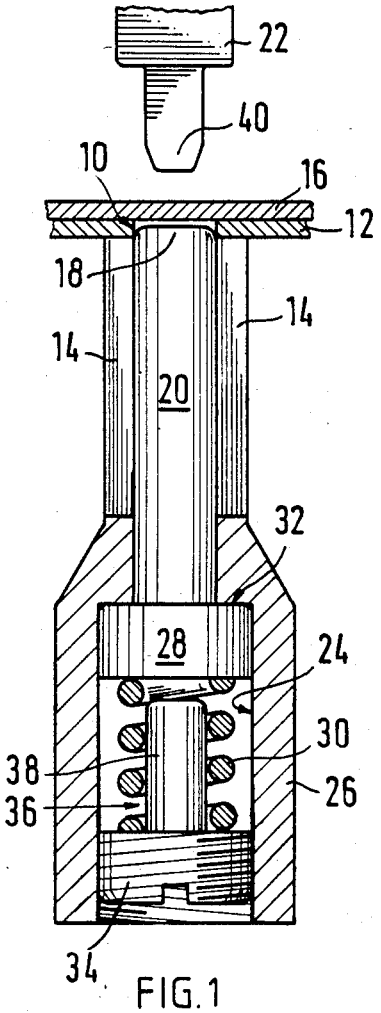
FIG. 1 is a section view of the apparatus and the two adjacent metal sheets with the die in a preparatory position.

As shown in FIG. 1, a second or lower sheet 12, which includes a perforation 10, is supported by support members 14 of the female die. The first or upper sheet 16 rests on the second sheet 12 with surface engagement therebetween. Head 18 of anvil 20 engages or fits into perforation 10, and it will be noted that the penetration depth of the head is less than the thickness of that lower sheet 12. Accordingly, the position of perforation 10 with respect to support members 14 and male die 22 is one where all are in alignment. Anvil 20 has a base or root portion 28 which is slidingly received and guided in a bore 24 formed in base member 26 which forms a portion of the female die. Anvil 20 is biased outwardly of bore 24 toward male die 22 through a separate bore having a reduced diameter to receive anvil 20 by means of a helical compression spring 30, and upward vertical movement is stopped by shoulder 32 of root portion 28 formed opposite one end of spring 30 when that shoulder abuts an edge formed in base member 26 about the reduced cylindrical bore through which anvil 20 slidingly fits. The other end of spring 30, opposite anvil 20, is supported by a bolt 34 which has an outer screw thread for engaging interior threads formed in the outer end of bore 24 of base member 26. A shaft portion 38 extends upwardly from bolt 34 and through the interior of spring 30, with the distal end of shaft 38 defining a stop to limit the downward displacement of anvil 20. Bolt 34 and shaft 38 form an integral stop member, that can be adjusted, generally indicated at 36.

Figure 3:
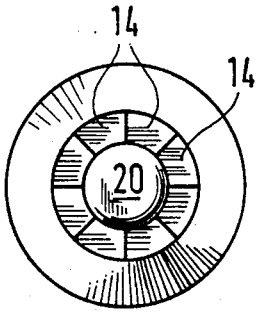
FIG. 3 is a plan view of the female die in FIGS. 1 and 2.

As shown in FIG. 3, base member 26 and anvil 20 have a circular section shape, and the support members are arranged to form a hollow cylinder surrounding anvil 20. However, each support member 14 is spaced from adjacent support members by a slot 15 so that the free upper ends of each of the support members may elastically yield outwardly while their lower ends are rigidly mounted at base member 26 or are integrally joined therewith as illustrated.

Figure 2:
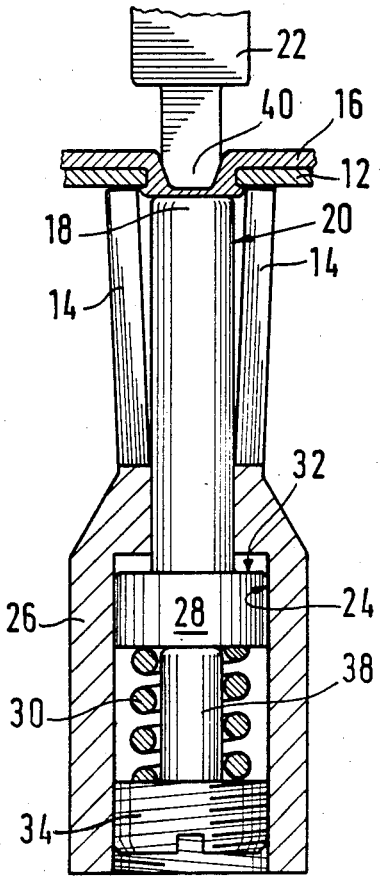
FIG. 2 shows the apparatus of FIG. 1 at the end of the working stroke of the press.

With the elements disposed as shown in FIG. 1, upon actuation of the press, working portion 40 of the male die will force the material of first sheet 16, located above perforation 10, which in the example of FIGS. 1–3 is a cylinderical hole, through that perforation displacing anvil 20 downwardly against the bias of spring 30 until its root portion 28 abuts the distal end of shaft 38. With continued press stroke, the material lying between the male portion 40 and the working surface of anvil 20 is plastically deformed in a lateral direction or swaged behind or past the edges of the perforation adjacent support members 14. This is possible because the free upper ends of support members 14 are elastically deflectable. Upon termination of the press stroke, the elements assume the shapes and positions as illustrated in FIG. 2.

Figure 4:
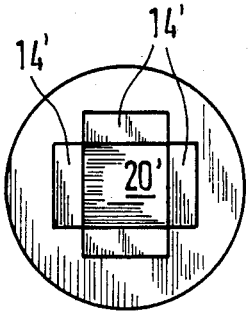
FIGS. 4 and 5 illustrate plan views of alternative designs of the female die.
Figure 5:
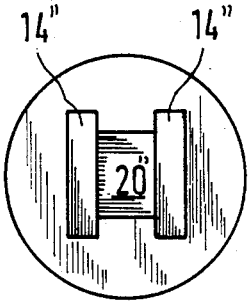

In the embodiments of FIGS. 4 and 5, respectively, the shape of the anvils 20' and 20'', respectively, and of the support members 14' and 14'', respectively, are adapted to cooperate, respectively, with square and elongated-rectangular perforations.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims, which scope is to be accorded the broadest interpretation so as to encompass all such modifications and equivalent structures.

What is claimed is:

1. An apparatus for connecting a first piece of sheet metal to a perforated second piece of sheet metal with connecting joints being formed through at least some of said perforations, the apparatus comprising:

a male die and a female die adapted to be mounted in a press device for relative reciprocation toward and away from each other, said male die cooperating with said female die upon actuation of said press device to force material of said first piece through said perforation, said female die having an anvil cooperating with said male die for swaging said forced-through material and having further support members juxtaposed to said anvil and adapted to support said second piece and to flex away from said anvil when displaced by swaged material, said male die having an operating surface facing said anvil and shaped with an exterior contour similar to, but smaller than the contour of said perforation, said contour being dimensioned such that forced-through material will not be severed from said first piece sheet metal, and said anvil having a head portion contoured complimentary to the shape of said perforation, said female die comprising biasing means mounted to bias said anvil into a preparatory position in which its head portion protrudes beyond said support members and from which the anvil is displaceable into a lowered swage position in which the anvil is rigidly supported and said support members protrude upwardly beyond said head portion by a distance smaller than the thickness of said first piece of metal sheet.

2. An apparatus as set forth in claim 1 wherein said female die further includes a base member on which said support members are mounted and adjustable stop means for adjusting the anvil swage position.

3. An apparatus as set forth in claim 2 wherein said anvil has a root portion and said base member has guide surfaces along which the root portion is guided when said anvil it is displaced.

4. An apparatus as set forth in claim 3 wherein said base member includes means defining a cylindrical hole the inner walls of which define said guide surfaces, said hole having a threaded end opposite said anvil to receive a threaded bolt serving as said stop means.

5. An apparatus as set forth in claim 2 wherein said adjustable stop means is vertically adjustable.

6. Apparatus for connecting a first sheet of metal to a second perforated sheet of metal through a least some of such perforations, said apparatus comprising opposed, space apart male and female dies adapted to be mounted in a press to provide relative reciprocation toward and away from each other, said female die including an anvil receprocatingly mounted within a base member, a plurality of support members each having two ends one of which is fixed to said base member so that each is positioned adjacent said anvil, the other end being free and laterally displaceable away from said anvil, said anvil having a head portion contoured about is periphery in a complimentary manner to fit through the perforations and being movable between an upwardly biased raised position protruding above the free ends of said support members and a lowered position spaced below such ends by a distance less than the thickness of said perforated sheet, said male die including means defining a working surface facing said anvil and having an exterior contour similar to but smaller than the contour of said perforations, said male die cooperating with said female die upon press actuation to force material of said first sheet through a perforation and swaged therebeyond, said male die being dimensioned so that the forced through material is not severed from said first piece.

* * * * *